US005270777A

United States Patent [19]

Yoshida et al.

[11] Patent Number: 5,270,777

[45] Date of Patent: Dec. 14, 1993

[54] FIXING APPARATUS HAVING HEAT CONDUCTING MEMBER INSIDE A FIXING ROLLER

[75] Inventors: Ikuyo Yoshida, Funabashi; Masaaki Sakurai; Hiromitsu Hirabayashi, both of Yokohama, all of Japan

[73] Assignee: Canon Kabushiki Kaisha, Tokyo, Japan

[21] Appl. No.: 899,143

[22] Filed: Jun. 17, 1992

Related U.S. Application Data

[63] Continuation of Ser. No. 630,763, Dec. 21, 1990, abandoned, which is a continuation of Ser. No. 286,251, Dec. 19, 1988, abandoned.

[51] Int. Cl.[5] ..... G03G 15/20

[52] U.S. Cl. ..... 355/290; 219/216

[58] Field of Search ..... 219/216, 469; 355/282, 355/285, 289, 290; 29/130, 132; 492/46, 53

[56] References Cited

U.S. PATENT DOCUMENTS

| | | | |
|---|---|---|---|
| 3,751,216 | 8/1973 | Gregory | 219/469 X |
| 4,145,599 | 3/1979 | Sakurai et al. | 219/216 |
| 4,377,336 | 3/1983 | Parks et al. | 355/290 |
| 4,595,274 | 6/1986 | Sakurai | 355/290 |
| 4,618,240 | 10/1986 | Sakurai et al. | 355/290 X |
| 4,813,372 | 3/1989 | Kogure et al. | 219/216 X |
| 4,842,944 | 6/1989 | Kuge et al. | 428/451 |
| 4,888,464 | 12/1989 | Shibata et al. | 219/216 |

FOREIGN PATENT DOCUMENTS

| | | |
|---|---|---|
| 0033474 | 2/1984 | Japan . |
| 0033475 | 2/1984 | Japan . |
| 0155873 | 9/1984 | Japan . |

OTHER PUBLICATIONS

Fink et al., Standard Handbook for Electrical Engineers, pp. 4-222, Nov. 1979.

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image fixing roller for heating and fixing an image includes a cylindrical base member, a surface layer, a heat generating element provided between the base member and the surface layer; and a heat conducting member provided inside said base member and having an outside diameter smaller than an inside diameter of said base member.

18 Claims, 4 Drawing Sheets

FIXING APPARATUS HAVING HEAT CONDUCTING MEMBER INSIDE A FIXING ROLLER

This application is a continuation of application Ser. No. 07/630,763 filed Dec. 21, 1990, now abandoned; which is a continuation of Ser. No. 07/286,251 filed Dec. 19, 1988, now abandoned.

FIELD OF THE INVENTION AND RELATED ART

The present invention relates to an image fixing roller and an image fixing apparatus for heating and fixing an unfixed image.

In the field of an electrophotographic apparatus such as a copying machine and a laser beam printer and an electrostatic recording apparatus such as a magnet-stylus printer, a heating roller is widely used for the purpose of fixing an image on a recording material.

Referring first to FIG. 2, an example of an image fixing apparatus using the heating roller is shown.

In this apparatus, a fixing roller 8 is contactable to an unfixed image to apply heat to the unfixed image, and it includes a core metal 81 having therein a heating source such as a halogen heater 13, a silicone rubber layer outside the core metal 81 and a surface layer made of material exhibiting good releasing property such as fluorine resin. A back-up or pressing roller 10 is in contact with the fixing roller 8 and rotates following the fixing roller 8.

The unfixed image formed on the recording material is fixed by pressure and heat, while the recording material is passed through the nip formed between the rollers 8 and 10.

The heating roller type image fixing apparatus is widely used since the fixing roller having the heating source is directly contacted to the recording material so that the heat efficiency is very good, the pressure can be also used for the image fixing, and the size of the apparatus can be reduced.

The surface temperature of the fixing roller 8 is detected by a temperature sensing element 11 such as a thermister, and the amount of heat by the heating element 13 is controlled so that the surface temperature of the roller is substantially constant at a proper level for the image fixing, by an unshown control circuit.

Cleaning felt 12 is effective to clean the roller by removing offset toner therefrom and is impregnated with a lubricant such as silicone oil to apply it to the roller to enhance the releasability thereof.

However, since the heating source is provided inside the core metal of the fixing roller, it takes a relatively longer time until the surface of the roller reaches a predetermined temperature, and therefore, a longer time period is required for the waiting time after energization of the apparatus. During the waiting time, the recording operation is not possible.

As an image fixing apparatus which maintains the advantages of the heating roller type and which requires a shorter period for reaching the predetermined temperature, the configuration shown in FIG. 3 has been considered in which a fixing roller 9 is provided with a heat generating element 5 outside the core metal 3, that is, near the surface layer. In FIG. 3, reference numerals 4 and 6 designate electrically insulative layers.

Since the roller of this type has the heat generating element outside the core metal, the temperature response at the roller surface is improved, so that the waiting time can be reduced, and the thermal efficiency is improved over the roller having the heat generating element inside the core metal 3 as shown in FIG. 2, because the heat loss from the heat generating element to the roller surface is reduced. Thus, by providing the heat generating element outside the core metal, the thermal responsivity and the thermal efficiency are improved.

However, it has been found that this image fixing apparatus involves the following problems when recording materials having a length, measured in the longitudinal direction of the rollers, which is smaller than the length of the image fixing roller having the outside heat generating element are continuously processed.

The temperature difference between the recording material passing area and the non-passing area of the length of the roller is large. If, immediately after the continuous processing of such small size recording materials, a larger (longer in the direction of the length of the roller) is processed, a high temperature off-set takes place in such an area of the large size recording material as corresponds to the non-passing area when the small size recording material was processed.

When the number of the continuous image fixing operations is large, the temperature excessively increases in the area where the rollers are not in contact with the recording material, with the result that recording material separating members and a cleaning member or members, which are in contact with the roller in the non-passing area are damaged, or that the releasing property of the roller surface deteriorates.

SUMMARY OF THE INVENTION

Accordingly, it is a principal object of the present invention to provide an image fixing roller and an image fixing apparatus wherein the waiting period is reduced, and non-uniform temperature along the length of the roller can be prevented.

It is another object of the present invention to provide an image fixing roller and an image fixing apparatus wherein a temperature rise in a recording material non-passing area of the fixing roller having a heat generating element outside a base member of the roller, is minimized.

It is a further object of the present invention to provide an image fixing roller and an image fixing apparatus wherein a heat generating layer is outside a base member of the roller.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
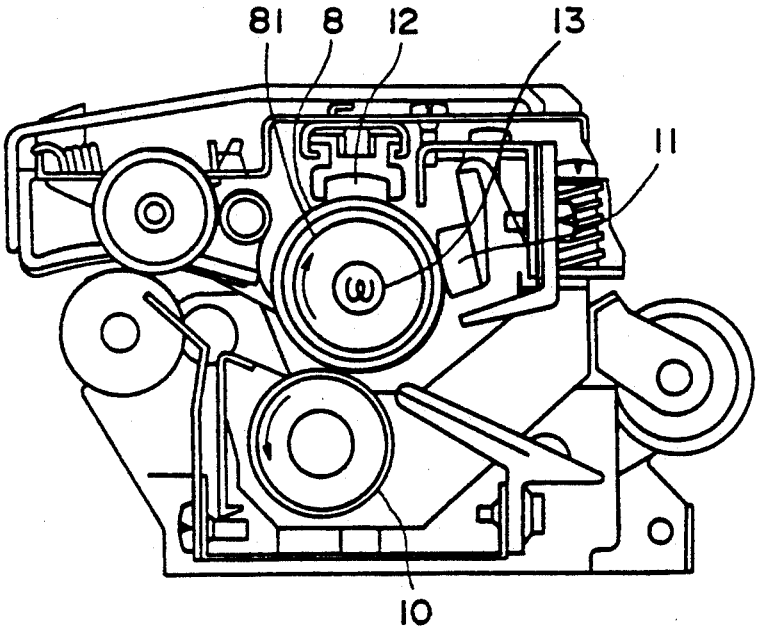
FIG. 2 PRIOR ART
FIG. 2 is a sectional view of a conventional image forming apparatus.
Figure 3:
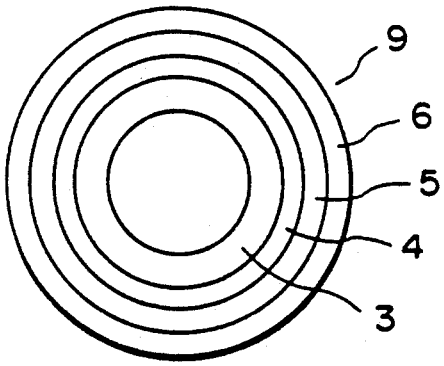
FIG. 3 PRIOR ART
FIG. 3 shows a sectional view of a conventional image fixing roller.
Figure 4:
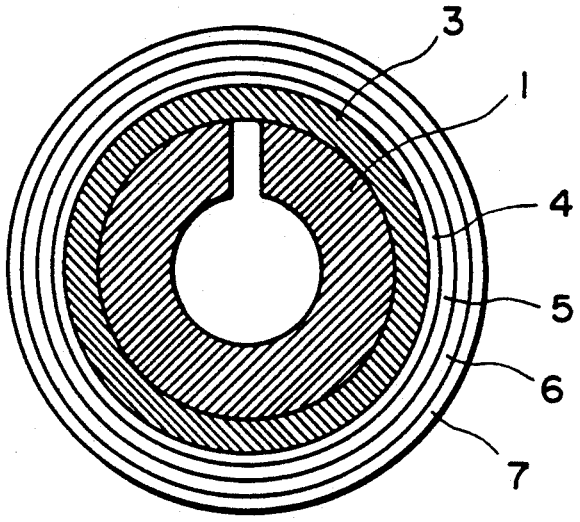
FIGS. 4, 5A, 5B, 6A, 6B and 7A, 7B are sectional views of image fixing rollers according to other embodiments of the present invention.

Referring to FIG. 4, there is shown in a cross-section an image fixing roller according to an embodiment of the present invention, which preferably takes place of the fixing roller 8 shown in FIG. 2.

The fixing roller has a heat conductive member 1 extending along the length of the roller and is made of a metal having a better thermal conductivity than a core metal 3.

The roller further includes insulative layers 4 and 6 and an off-set preventing layer 7 outside thereof, the off-set preventing layer 7 being made of fluorine resin exhibiting good releasing property. It is possible that one layer is provided to perform both of the functions of the insulative layer 6 and the off-set preventing layer 7. However, since the surface of the fixing roller tends to be electrically charged up by friction with the recording material, it is preferable that an insulative layer is disposed between the roller surface and a heat generating layer 5 as in this embodiment, so as to assure the electric isolation between the surface of the roller and the heat generating element.

By providing in the core metal or base member the heat conductive member 1 having a good thermal conductivity, the non-uniformness of the temperature of the core metal 3 along the length of the roller can be prevented, and therefore, the non-uniformness of the surface temperature of the roller can be minimized. The heat conductive member 1 preferably has a length measured in the longitudinal direction of the roller which is larger than at least a minimum size of the recording material, further preferably than a maximum size of the recording material. In addition, when a member such as a cleaning member and an oil application member is contacted to the surface of the roller, the length is preferably larger than that of the contact area therebetween.

However, if the heat conducting member 1 is closely contacted to the insulative surface of the roller (press-fitting or the like), the amount of heat transfer from the roller core metal to the heat conductive member 1 is large, with the result that the heat capacity of the entire roller becomes large. Therefore, the advantage of the short waiting time due to the heat generating element outside the core metal is adversely affected.

Also, at the initial stage of the image fixing operation in which the heat conductive member 1 is not sufficiently heated, the heat radiation toward the inside of the roller becomes large, with the result that the image fixing power is deteriorated.

Figure 1A:
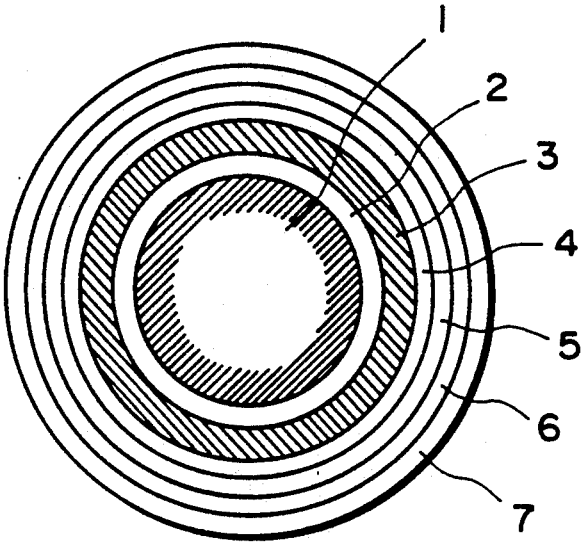
FIGS. 1A and 1B are sectional views according to embodiments of the present invention.
Figure 1B:
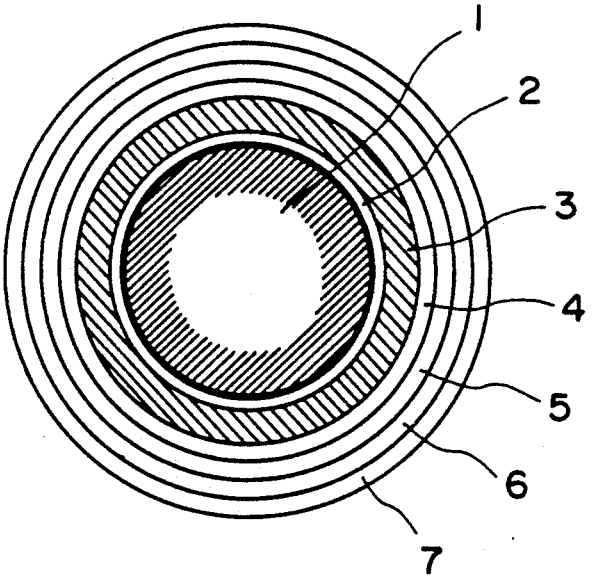

FIGS. 1A and 1B illustrate a preferable embodiment which solves this problem, too.

As shown in FIG. 1A, the heat conducting member 1 has an outside diameter smaller than the inside diameter of the core metal 3, so that a clearance 2 is formed between the heat conductive member 1 and the core metal 3 at a normal temperature.

When the temperature of the roller is low, the clearance 2 serves as a heat insulative member, and therefore, the amount of heat transfer from the core metal 3 is small, so that the waiting time is not increased.

It is to be noted that the heat conductive member 1 is made of a material having a larger coefficient of thermal expansion than that of the core metal 3 in this embodiment. With the temperature rise of the roller, the temperature of the heat conducting member 1 increases. When the temperature of the recording material non-passing area is extremely increased so that temperature non-uniformness occurs along the length of the roller, the clearance 2 decreases or disappears as shown in FIG. 1B, and therefore, the heat transfer from the core metal 3 to the conductive member 1 in such an area increases to make the temperature distribution uniform along the longitudinal direction of the roller.

Since the outside diameter of the heat conducting member 1 is smaller than the inside diameter of the roller at normal temperature, and therefore, the heat conducting member 1 is easily, safely and quickly inserted into the roller, and therefore, the layers constituting the roller are not stressed.

The difference between the outside diameter of the heat conducting member 1 and the inside diameter of the roller is preferably not less than 10 microns, and further preferably not less than 20 microns.

In FIG. 1 embodiment, the clearance 2 is formed along the entire periphery of the roller, but since the temperature non-uniformness does not arise in the rotational direction of the roller, they may be partly contacted in that direction. In that case, it is preferable that the contact width is uniform along the length of the roller, particularly line contacts are preferable. With the line contacts, the waiting period is not increased, as contrasted to FIG. 4 embodiment, and simultaneously, the heat flow at the high temperature is improved, and therefore, the effect of making the temperature uniform along the length of the roller is increased, and for this reason, it is preferable.

Figure 5A:
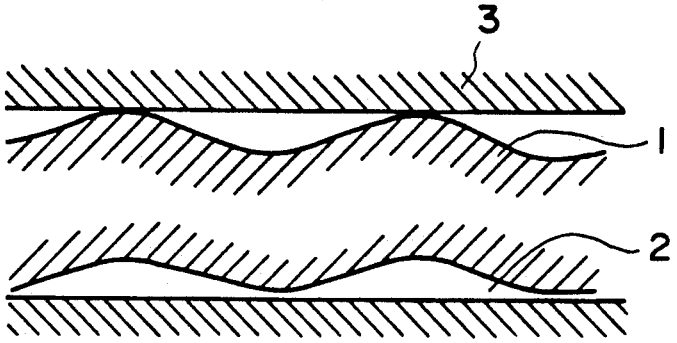
Figure 5B:
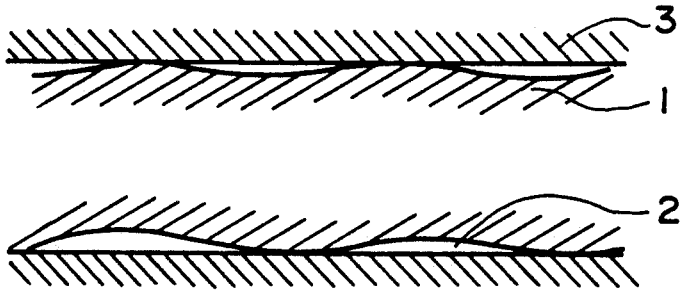

FIGS. 5A, 5B, 6A, 6B, 7A and 7B show other embodiments. The configuration of the heat conducting member may be modified. FIG. 5A shows an example wherein the conducting member 1 is waved relative to the core metal 3 in a longitudinal section. During the waiting period, the conducting member and the core metal 3 are contacted at points, and therefore, the problem described above does not arise, but at a high temperature, they are contacted in areas as shown in FIG. 5B, and therefore, the heat flow along the longitudinal direction of the roller is increased.

The waveform along the longitudinal direction substantially decreases the clearance 2, and therefore, the influence to the waiting period by variation in the inside diameter of the core metal 3 and the variation in the outside diameter of the heat conducting member 1 can be prevented. This means that the required accuracy of the clearance is eased, and therefore, it is preferable.

Figure 6A:
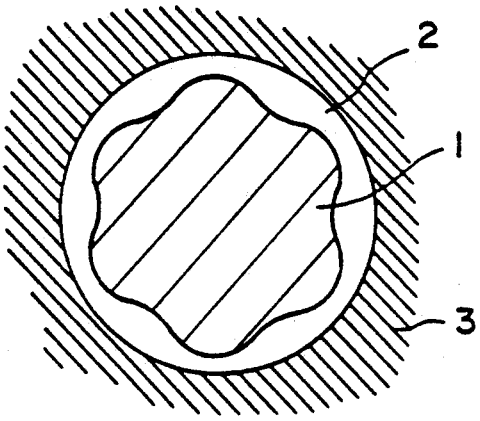
Figure 6B:
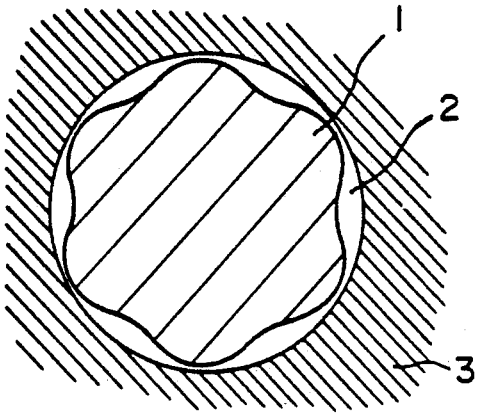

FIGS. 6A and 6B show another example in cross-sections. In this example, the outer periphery of the heat conducting member 1 is wavy relative to the inside periphery of the core metal 3 in a cross-section, thus providing plural line contacts therebetween. By this structure, the heat flow is increased in the longitudinal direction of the roller. In addition, by maintaining the sufficient clearances adjacent the small diameter portion of the conducting member 1, whereby the heat capacity of the entire roller is prevented from becoming large.

FIG. 6B shows the state when the temperature is high, and the large diameter portions of the heat conducting member 1 are close to or in contact to the inside surface of the core metal 3.

Figure 7A:
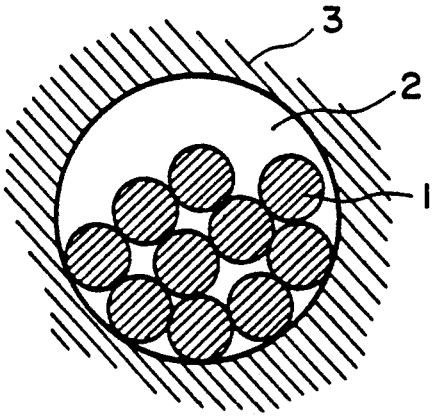

The plural line contacts as shown in FIG. 6 are accomplished by another structure as shown in FIG. 7A, wherein plural heat conducting members are disposed inside the core metal 3.

Figure 7B:
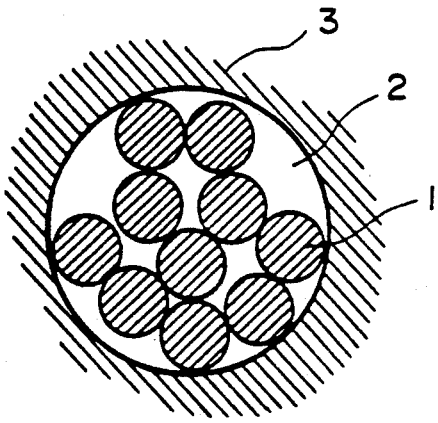

FIG. 7B shows the state when the temperature is high.

By using plural heat conducting members, the plural line contacts can be accomplished without complicated shape as shown in FIG. 6.

While the invention has been described with reference to the structures disclosed herein, it is not confined to the details set forth and this application is intended to cover such modifications or changes as may come within the purposes of the improvements or the scope of the following claims.

What is claimed is:

1. An image fixing roller for heating and fixing an image, comprising:

a cylindrical base member;

a surface layer;

a heat generating element provided between said base member and said surface layer; and a heat conducting member inside said base member, said heat conducting member having an outside diameter smaller than an inside diameter of said base member when the roller is at a low temperature relative to a fixing temperature, thereby leaving a gap between said heat conducting member and said base member at said low relative temperature, and wherein said gap narrows when the roller has a high temperature relative to a fixing temperature whereby said heat conducting member conducts heat along the length of said roller.

2. A roller according to claim 1, wherein said surface layer comprises a surface releasing layer.

3. A roller according to claim 1, wherein said heat conducting member has a coefficient of thermal expansion larger than that of said base member.

4. A roller according to claim 1, wherein said heat conducting member has a coefficient of thermal conductivity which is larger than that of said base member.

5. A roller according to claim 1, wherein said base member is a core metal.

6. A roller according to claim 1, wherein said heat conducting member extends in a longitudinal direction of said roller.

7. A roller according to claim 6, wherein said heat conducting member has a length larger than a maximum fixable width of the fixing roller.

8. A roller according to claim 1, wherein said heat conducting member extends in a longitudinal direction of said roller and at said high temperature is in contact with said base member in a longitudinal direction.

9. An image fixing apparatus, comprising:

a pair of rollers for forming a nip therebetween through which an image carrying member carrying an unfixed image is passed to fix the image;

one of said rollers, comprising:

a cylindrical base member;

a surface layer;

a heat generating element provided between said base member and said surface layer; and a heat conducting member inside said base member, said heat conducting member having an outside diameter smaller than an inside diameter of said base member when the roller is at a low temperature relative to a fixing temperature, thereby leaving a gap between said heat conducting member and said base member at said low relative temperature, and wherein said gap narrows when the roller has a high temperature relative to a fixing temperature whereby said heat conducting member conducts heat along the length of said roller.

10. An apparatus according to claim 9, wherein said surface layer of said one of said rollers comprises a surface releasing layer.

11. An apparatus according to claim 9, wherein said heat conducting member has a coefficient of thermal expansion larger than that of said base member.

12. An apparatus according to claim 9, wherein said heat conducting member has a coefficient of thermal conductivity which is larger than that of said base member.

13. An apparatus according to claim 9, wherein said base member is a core metal.

14. An apparatus according to claim 9, wherein said heat conducting member extends in a longitudinal direction of said one of said rollers.

15. An apparatus according to claim 14, wherein said heat conducting member has a length larger than a maximum fixable width of one of said rollers.

16. An apparatus according to claim 14, further comprising a cleaning member for cleaning said one of the rollers, and wherein said heat conducting member is longer than a length of contact between the cleaning member and said one of said rollers.

17. An apparatus according to claim 14, further comprising a member for applying oil to said one of the rollers, wherein said heat conducting member has a length larger than a length of contact between the oil application member and said one of said rollers.

18. An apparatus according to claim 9, wherein said heat conducting member extends in a longitudinal direction of said one of said roller and at said high temperature is in contact with said base member in a longitudinal direction.

* * * * *

UNITED STATES PATENT AND TRADEMARK OFFICE

CERTIFICATE OF CORRECTION

PATENT NO. : 5,270,777

DATED : December 14, 1993

INVENTOR(S) : IKUYO YOSHIDA, ET AL.

It is certified that error appears in the above-identified patent and that said Letters Patent is hereby corrected as shown below:

On the Title Page
insert --[30] Foreign Application Priority Data Dec. 18, 1987 [JP] Japan....62-320583--.

COLUMN 3
Line 25, "member" should read --member 3--.

COLUMN 4
Line 58, "whereby" should be deleted.

COLUMN 6
Line 4, "rollers," should read --rollers--;
Line 50, "roller" should read --rollers--.

Signed and Sealed this

Second Day of August, 1994

*Attest:*

*Attesting Officer*

BRUCE LEHMAN

*Commissioner of Patents and Trademarks*